United States Patent [19]

De France

[11] 4,050,761

[45] Sept. 27, 1977

[54] CUP-SHAPED UNDERGROUND TAP CONNECTOR

[75] Inventor: Robert V. De France, Poughkeepsie, N.Y.

[73] Assignee: Fargo Mfg. Company, Inc., Poughkeepsie, N.Y.

[21] Appl. No.: 705,806

[22] Filed: July 16, 1976

[51] Int. Cl.[2] ..... H01R 11/20

[52] U.S. Cl. ..... 339/97 R

[58] Field of Search ..... 339/97–99

[56] References Cited

U.S. PATENT DOCUMENTS

| | | | |
|---|---|---|---|
| 2,196,964 | 4/1940 | Lee | 339/97 R |
| 2,518,489 | 8/1950 | Orlando | 339/97 R |
| 2,694,183 | 11/1954 | Edlen et al. | 339/97 P |
| 3,789,347 | 1/1974 | Cooper, Jr. | 339/97 R |

FOREIGN PATENT DOCUMENTS

| | | | |
|---|---|---|---|
| 506,443 | 11/1951 | Belgium | 339/99 R |
| 471,769 | 11/1914 | France | 339/97 R |
| 479,167 | 11/1969 | Switzerland | 339/97 R |

*Primary Examiner*—Joseph H. McGlynn
*Attorney, Agent, or Firm*—Kane, Dalsimer, Kane

[57] ABSTRACT

A connector for joining a tap conductor to a run conductor of an underground cable system without removing the insulation from the run conductor. The connector includes a body of conductive material adapted to be connected to a tap conductor and having a piercing member for passage through the insulation of a run conductor. A clamp is provided to couple the piercing member to the run conductor. The clamp is adjustable for bringing the piercing member into tight interengagement with the run conductor and then supplying sufficient force to direct it through the insulation of the run conductor and into electrical communication with the interior thereof. The piercing member has a hollow cup-shaped configuration to minimize the force required to penetrate the insulation, provide maximum contact area for current transfer with low unit pressure on the conductor strands and small sealing area.

3 Claims, 5 Drawing Figures

CUP-SHAPED UNDERGROUND TAP CONNECTOR

BACKGROUND OF THE INVENTION

It has become highly desirable to bury electrical transmission cables underground. Assemblies for such underground applications, for example, connectors wherein a tap conductor is joined to a run conductor, must be specifically designed with this underground use in view. Where direct burial has taken place, the connection of electrical conductors is made and left frequently without the benefit of a protective enclosure in the ground. Therefore, the connector must be moisture proof and proper sealing must be provided. This condition is aggravated by the fact that in underground insulations there is a tremendous buildup of pressure due to variations of moisture in the air and the connector must be designed with this factor being recognized.

Various solutions have been derived to maintain the water tight seals necessary between the components utilized in connecting the tap conductor to the underground run conductor. Examples are apparent in U.S. Pat. No. 3,579,173 and U.S. Pat. No. 3,848,956.

The connectors must be easily applied without the use of special tools and provide for installation while the cable is "live", provide good mechanical and electrical connections with appropriate moisture seals, have long life underground and be capable of easy disconnect of the tap connector with a minimum amount of repairs for the run conductor required. Additionally, there must be no need for cutting the main cable during installation, of "skinning" either the main run conductor cable or tap conductor, and there must be no installation damage to the line or cable resulting from the application of the connector.

An additional problem which is now recognized and which should be avoided is the application of undue stress to the insulation of the run conductor when the connection is made causing the insulation to crack or deteriorate over a period of time which would, of course, cause leakage and undesirable damage. Furthermore, the connection should be of the type whereby minimum distortion of the run conductor results when the connection is made. This applies to both the exterior insulation material and the interior conductor wires. Damage to the interior wires should be maintained at a minimum and if possible the wire should not be disturbed at all.

SUMMARY OF THE INVENTION

With the above background in mind, it is among the primary objectives of the present invention to provide a connector for joining a tap conductor to a run conductor of an underground cable system without disturbing the sealed integrity of the underground system and not subjecting the underground system to undue stresses. The connection is accomplished easily and efficiently by means of penetration of the insulated underground conductor quickly and effectively to gain electrical access to the interior thereof without subjecting the insulation covering the cable to undue stresses and without deforming or otherwise deleteriously affecting the interior wire in the cable. The object is to avoid subjecting the cable to stresses which result in cracks and zones of weakening producing deteriation and ultimate leakage in the underground system. The connection is accomplished in a quick and efficient manner without the necessity of having to remove the insulation from the underground cable and with the use of a connector which preserves the sealed integrity of the underground cable and permits connection with a tap conductor of a variety of different gauge sizes. The use of the cup-shaped piercing member and penetration means minimizes the force necessary for penetration, provides maximum contact area for current transfer with low unit pressure on the conductor strands and no conductor damage.

In summary, a connector is provided for joining a tap conductor to a run conductor of an underground cable system without removing the insulation from the run conductor. The connector includes a body of conductive material adapted to be connected to a tap conductor and having a piercing member for passage through the insulation of a run conductor. Clamping means is provided for coupling the piercing member to the run conductor. Adjustment means are provided on the clamping means for bringing the piercing member into tight interengagement with the run conductor and then supplying sufficient force to direct the piercing member through the insulation of the run conductor and into electrical communication with the cable strands. The piercing member has a cup-shaped configuration to permit piercing of the insulation and collection of a plug of insulation therein so as to minimize the stresses on the remainder of the insulated run conductor when the piercing member is in electrical contact with the cable strands. In this manner the electrical connection is completed between the run conductor and the tap connector interconnected with the piercing member.

With the above objectives among others in mind, reference is had to the attached drawings.

DESCRIPTION OF THE PREFERRED EMBODIMENT

Figure 1:
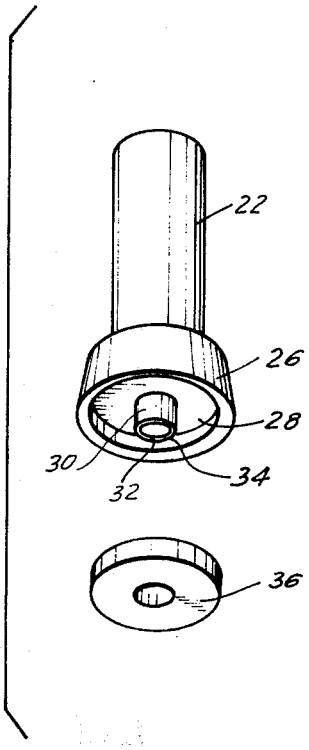
FIG. 1 is an exploded view of the piercing member of the connector of the invention and the sealing pad associated therewith.
Figure 2:
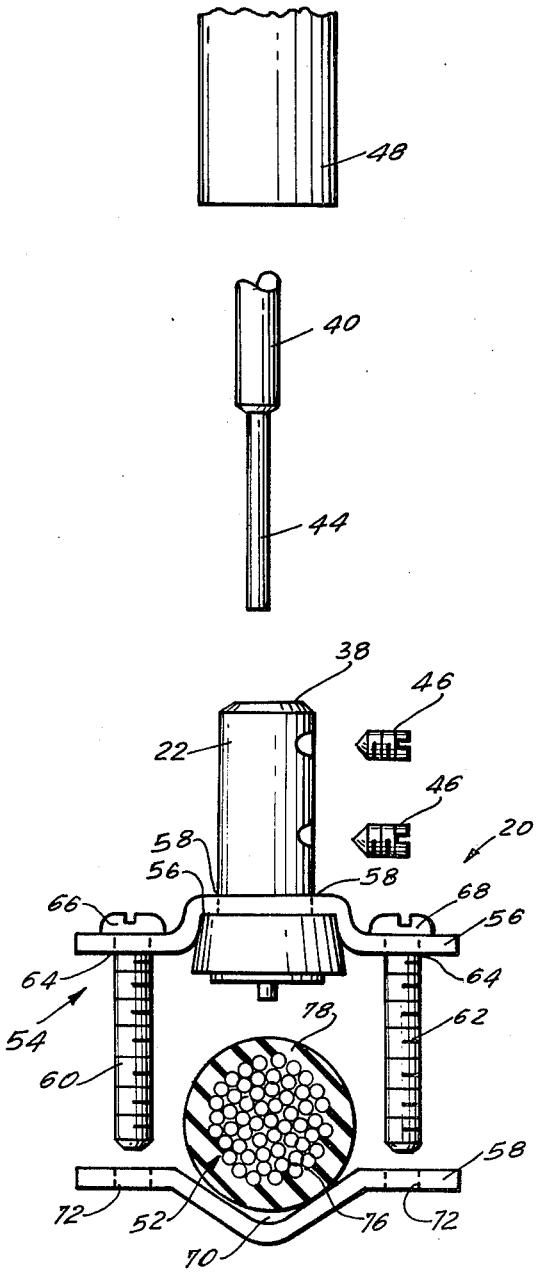
FIG. 2 is an exploded view of the connector of the invention and the associated components therewith to complete connection between a tap conductor and a run conductor.

In the embodiment depicted in FIGS. 1-5 connector 20 includes a substantially tubular body portion 22 which is of a conductive material, such as aluminum. On the lower end of the tubular body is a cylindrical flanged end 26 having a hollow interior to form a recess 28 and provide a central piercing member 30. The piercing member 30 is generally cylindrical or cup-shaped in configuration and is hollow to form a central aperture or recess 32. The rim 34 at the lower end of the piercing member 30 forms a cutting edge.

The recess formed between tip 30 and the inner surface of flange 26 is adapted to receive a disc-like sealing pad 36 of plyable plastic sealing material commonly known as "glit" of any similar sealing material which has a deformable plyable plastic-like nature to form a seal around the aperture which is cut by cutting edge 32 during operation of the connector.

Tubular body 22 has a central recess 38 for reception of tap wire 40. As shown, the tap wire 40 has insulation about its surface with the exception of the projecting portion 44 which is extendible into recess 38 for connection with the electrical conductor piercing member. The recess 38 is provided with sufficient diameter to accept a variety of different size wires which are maintained in position therein by set screws 46 which extend laterally through the wall of body 22 and engage with wire 44 to seal it against the inner surface of body 22. A suitable and conventional rubber boot 48 can be applied to the exterior surface of the interconnected wire 44 and body 22 of the piercing member to protect and cover the exposed connector portions.

Figure 4:
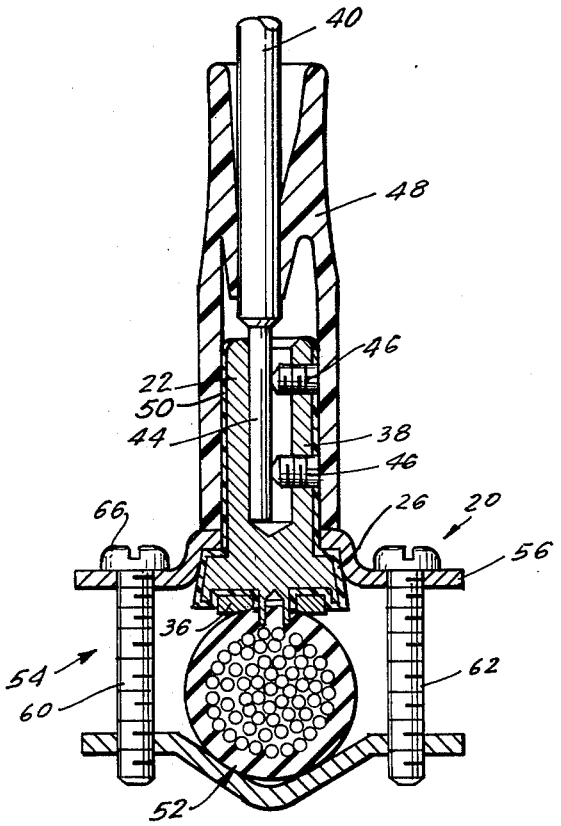
FIG. 4 is a sectional elevation view thereof taken along the plane of lines 4—4 of FIG. 3.
Figure 3:
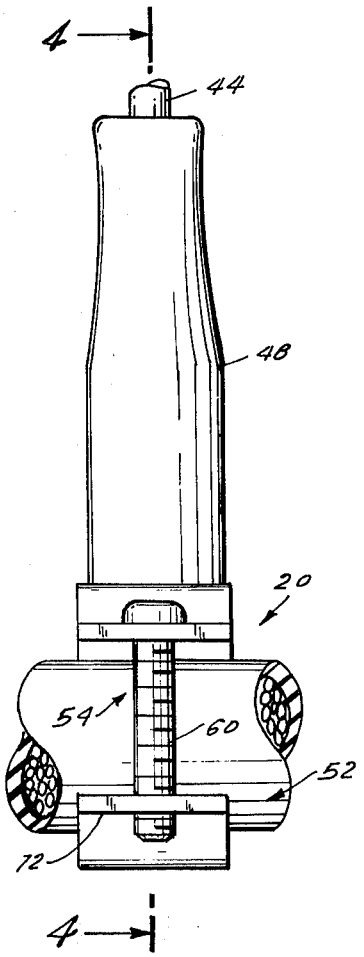
FIG. 3 is a fragmentary end elevation view thereof in assembled condition.
Figure 5:
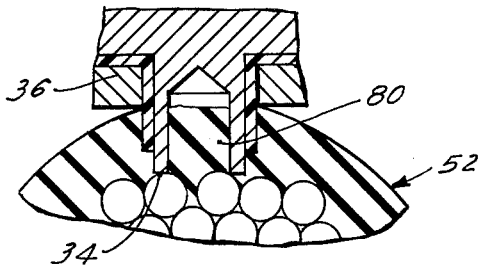
FIG. 5 is an enlarged fragmentary view of the piercing member thereof making an electrical connection with the cable strands of the run conductor.

It has been found to be desirable to coat the major portion of the outer surface of piercing member 22 with nylon coating 50 which extends substantially over the entire surface with the exception of the projecting piercing tip rim 34 as seen in FIG. 4.

To interconnect piercing member 22 with an underground run conductor 52 as shown in horizontal position in the drawings, an appropriate fastening clamp assembly 54 is employed. Clamp assembly 54 includes a top plate 56 and a bottom plate 58 which are releasably interconnected by means of screws 60 and 62. Upper plate 56 concludes a central aperture 58 large enough to extend tubular body 22 therethrough but small enough so that the upper surface of flange portion 26 engages with surfaces of plate 56 surrounding apertures 58. In fact, the central portion of plate 56 is shaped to generally conform to the corresponding surfaces of tubular body 22 and flange 26. Each end of plate 56 contains an aperture 64 for passage of the threaded portion of screws 60 and 62 therethrough with the corresponding heads 66 and 68 of the screws engaging with the upper surface of the plate.

Plate 58 has a central V-shaped portion 70 which forms a seating surface for the insulated run conductor 52 so as to center the conductor for interconnection with the piercing member. Threaded apertures 72 are formed in bottom plate 58 and align with apertures 64 so that threaded screws 60 and 62 can be brought into threaded interengagement with apertures 72 and 74 and the plates directed toward one another under the influence of the adjustment screws 60 and 62 to accomplish the electrical connection with run conductor 52.

Run conductor 52 is a conventional type of underground cable including a plurality of interior wire strands 76 surrounded by a cylindrical insulation covering 78.

In operation, the underground conductor 52 is exposed and bottom plate 58 is positioned under the conductor with the conductor seated in the V-shaped central portion 70 of bottom plate 58. Body 22 is inserted into central aperture 58 of top plate 56 with the upper surface of flange 26 seated against the undersurface of the plate. Exposed wire portion 44 of tap 40 is inserted in recess 38, and set screws 36 are tightened to make the tight electrical connection between wire 44 and conductor piercing member 30. A protective rubber boot is positioned over the interconnected wire 44 and body 22 until it seats against the upper surface of plate 56 and protects the interconnected tap connection.

Screws 60 and 62 are passed through apertures 64 and are threaded into receiving apertures 72 and 74 respectively in bottom plate 58 to bring plates 56 and 58 toward one another until rim 34 engages with the outer surface of insulation 78 on run conductor 52. It should be noted that prior to interconnection of the threaded screws with the bottom plate 58 sealing pad 36 is inserted in recess 28 so that it is in position to engage with the outer surface of insulation 78 around the cup-shaped piercing member 30 as it comes into engagement with the insulation 78. In this manner, the sealing relationship about the piercing tip is preserved.

Further threading of screws 60 and 62 causes the plates 58 and 56 to be drawn together and causes rim 34 to puncture the insulation 78 and come into electrical connection with wire 76 in the run conductor. The plug 80 of insulation material cut by the cup-shaped member 30 is retained in the recess 32 thereby preventing any peripheral stresses on the remainder of the insulation covering 70 and alleviating the danger of cracks or points of failure at other surface areas on the insulation 78 of the run conductor.

Furthermore, by controlling the progression of the piercing member 30 through the insulation the distance of travel can be closely controlled so that once contact is made between cup 34 and strands 76 no further penetration is necessary. Accordingly, deformation or destruction of the inner wire strands 76 is avoided. As stated above, the sealing about the puncture point is protected by the presence of sealing pad 36 surrounding the puncture position.

When electrical contact has been accomplished, no further threading of screws 60 and 62 is necessary and the plates 56 and 58 can be retained in that position with the resultant electrical connection being achieved between wire 44 through the electrically conductive piercing member 30 and body 22 into electrical connection with wire 76 in run conductor 52. Over-clamping is protected against by the closely controlled threaded progression between plates 56 and 58 as accomplished by screws 60 and 62.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A connector for joining a tap conductor to a run conductor of an underground cable system without removing the insulation from the run conductor comprising: respective insulated and uninsulated portions of said tap conductor, a body of conductive material adapted to be connected to said uninsulated portion, a piercing member of said body for passage through the insulation of said run conductor, clamping means for coupling said piercing member to said run conductor, adjustment means of said clamping means for bringing said piercing member into tight interengagement with said run conductor and supplying sufficient force to direct said piercing member through the insulation of said run conductor and into electrical communication with the interior thereof, said piercing member having a cup-shaped configuration to permit piercing of the insulation and collection of a plug of insulation therein so as to minimize the stresses on the remainder of the insulated run conductor when the piercing member is electrically connected with the interior of the run conductor to complete an electrical connection between said run conductor and said tap conductor connected to said piercing member, said body being substantially tubular in configuration terminating in a lower flanged end, said piercing member extending from said flanged end and being of hollow cylindrical configuration whereby the rim thereof forms a cutting surface, a recess in the end of said piercing member opposite the flanged end to receive a tap wire therein, releasable lock means to hold the tap wire in electrical communication in the recess in said body, the exterior surface of said body and said flange being coated with a nylon material, the recess formed in said piercing member to receive the tap wire being large enough to receive a multiplicity of size wires and said locking means being in the form of at least one set screw adapted to be threaded laterally into and out of the recess so as to engage a wire extended therein and retain it in position in electrical contact with said body, and said body and said piercing member being of aluminum material.

2. A connector for joining a tap conductor to a run conductor of an underground cable system without removing the insulation from the run conductor comprising: respective insulated and uninsulated portions of said tap conductor, a body of conductive material adapted to be connected to said uninsulated portion, a piercing member of said body for passage through the insulation of said run conductor, clamping means for coupling said piercing member to said run conductor, adjustment means of said clamping means for bringing said piercing member into tight interengagement with said run conductor and supplying sufficient force to direct said piercing member through the insulation of said run conductor and into electrical communication with the interior thereof, said piercing member having a cup-shaped configuration to permit piercing of the insulation and collection of a plug of insulation therein so as to minimize the stresses on the remainder of the insulated run conductor when the piercing member is electrically connected with the interior of the run conductor to complete an electrical connection between said run conductor and said tap conductor connected to said piercing member, said body being substantially tubular in configuration terminating in a lower flanged end, said piercing member extending from said flanged end and being of hollow cylindrical configuration whereby the rim thereof forms a cutting surface, a recess in the end of said piercing member opposite the flanged end to receive a tap wire therein, releasable lock means to hold the tap wire in electrical communication in the recess in said body, a coating of nylon material covering the exterior surface of said body and said flange, the surface of the end of the flange surrounding said piercing member forming a recess, a plyable plastic sealing pad within said recess to seal the area around the zone of penetration of said piercing member into the run conductor, the hollow interior of said piercing member forming a receptacle for the cut plug of insulation of the run conductor when the run conductor is pierced by said piercing member and an insulation boot embracing said insulated portion and engaging said coating of nylon with the boot having a passageway therethrough for introduction of the tap wire into the recess for connection to the connector.

3. The invention in accordance with claim 2 wherein the clamping means includes a top plate and a bottom plate, the top plate having a central aperture therein to receive said body therethrough and to engage with said flange, said bottom plate having a configuration to seat said run conductor therein, said top and bottom plates each respectively having a pair of threaded openings spaced apart so as to be adjacent to opposing edges of the plate and the apertures in one plate aligned with the apertures in the other plate so as to receive a threaded screw therein whereupon when a piercing member is coupled with the top plate and a run conductor is positioned between the plates in alignment with the piercing member and the screws are threaded to bring the top and bottom plates together the piercing member will be forced through the insulation of the run conductor to form the electrical connection with the interior thereof.

* * * * *